US005954138A

United States Patent [19]

Gabriel

[11] Patent Number: 5,954,138

[45] Date of Patent: Sep. 21, 1999

[54] FIRE EXTINGUISHER VALVE AND FIRE-EXTINGUISHING EQUIPMENT

[75] Inventor: Karl Gabriel, Steinsel, Luxembourg

[73] Assignee: Ceodeux-Fire Extinguisher Valves Technology S.A., Lintgen, Luxembourg

[21] Appl. No.: 09/153,142

[22] Filed: Sep. 14, 1998

Related U.S. Application Data

[63] Continuation of application No. PCT/EP97/01217, Mar. 10, 1997.

[30] Foreign Application Priority Data

Mar. 20, 1996 [LU] Luxembourg ..... 88729
Apr. 30, 1996 [LU] Luxembourg ..... 88757

[51] Int. Cl.[6] ..... A62C 37/36

[52] U.S. Cl. ..... 169/20; 169/46; 137/72; 137/491

[58] Field of Search ..... 169/46, 19, 20, 169/26, 54; 137/72, 491, 489

[56] References Cited

U.S. PATENT DOCUMENTS

| | | | |
|---|---|---|---|
| 3,791,450 | 2/1974 | Poitras | 137/72 X |
| 3,812,914 | 5/1974 | Mears | 169/20 |
| 3,827,502 | 8/1974 | Lockwood | 169/51 |
| 4,305,469 | 12/1981 | Morrisette | 169/20 X |
| 4,356,868 | 11/1982 | Bentley et al. | 169/26 |
| 5,653,291 | 8/1997 | Sundholm | 169/20 |

FOREIGN PATENT DOCUMENTS

| | | |
|---|---|---|
| 0010465A2 | 4/1980 | European Pat. Off. . |
| 2115905 | 9/1983 | United Kingdom . |
| 2128084 | 4/1984 | United Kingdom . |
| WO 91/08022 | 6/1991 | WIPO . |

*Primary Examiner*—Lesley D. Morris
*Attorney, Agent, or Firm*—Smith, Gambrell & Russell, LLP

[57] ABSTRACT

The fire-extinguishing device proposed includes a container, holding a gas under pressure, and a fusible hollow element designed to actuate the device. The fusible hollow element is connected to the extinguishant container in such a way that it is acted on by the compressed gas in the container. A pressure regulator is fitted between the extinguishant container and the fusible hollow element. The pressure regulator enables the device to be operated using $CO_2$ for instance as the extinguishant, even in situations in which the ambient temperature varies widely. The fusible hollow element can also be designed as a feed line for the extinguishant. Also proposed is a valve for a fire-extinguishing device of this kind.

17 Claims, 2 Drawing Sheets

FIRE EXTINGUISHER VALVE AND FIRE-EXTINGUISHING EQUIPMENT

This is a continuation application of PCT patent application No. PCT/EP97/01217 filed on Mar. 10, 1997 (Published as International Publication No. WO 97/34659 on Sep. 25, 1997), which application is incorporated herein by reference in its entirety.

The invention relates to a fire-extinguisher valve and fire-extinguishing equipment with such a valve.

Under the name "Fire Trace® System", the applicant distributes fire-extinguishing equipment, which trips automatically without outside energy in the event of a fire. The "Fire Trace® System" consists essentially of at least one extinguishing medium tank, which contains a gaseous pressure medium as propellant or extinguishing gas, and a special hose, which is connected to the extinguishing medium tank and is pressurised by the gaseous pressure medium in the extinguishing tank. The special hose under pressure is mounted above the point with a potential fire hazard. It consists of a specially developed, aging-resistant and diffusion-tight polymer material and is designed in such a way that the hose wall bursts, e.g. at a temperature between 100 and 110° C. and allows the gaseous pressure medium to escape.

There are two variants of the "Fire Trace® System". In a first variant the hose is connected directly to the extinguishing medium tank. When the hose bursts in the event of fire, the extinguishing medium flows through the hose as far as the burst point, where it is released. Hence the hose serves both as a tripping element and as a conveying line for the extinguishing medium. In a second variant the hose is connected by a special fire-extinguisher valve to the extinguishing medium tank. As soon as the pressure in the hose falls in relation to the pressure in the extinguishing medium tank, this control valve opens in order to release the contents of the extinguishing medium tank. A pressure drop in the hose occurs, of course, if in the case of fire the hose bursts at any point under the effect of heat. With this variant several extinguishing-medium tanks can be activated simultaneously in the event of a fire, so that a specific concentration of a gaseous extinguishing medium can be achieved without trouble, e.g. in a closed space.

The above-mentioned fire-extinguisher valve comprises a valve seat, a diaphragm-type closing element, which is assigned to the valve seat, and a tripping chamber, in which the closing element forms a pressure area. A connecting hole through the closing element links the tripping chamber under pressure to the extinguishing medium tank. The closing element with its pressure area is designed and arranged in such a way that it is pressed against the valve seat in the case of pressure equalisation between the extinguishing medium tank and tripping chamber and is lifted off the valve seat when the pressure drops in the tripping chamber. The pressure drop in the tripping chamber is produced by bursting of the hose, which is connected directly to the tripping chamber.

Fire-extinguisher valves with a closing piston as described, for example, in EP-A-0010465 and GB-A-2115905 are likewise suitable for the "Fire TRACE® System".

So far this "Fire Trace® System" has been used extremely successfully with extinguishing powders, water, AFFF foam or the new halon exchange gases. However, the operating principle of the "Fire Trace® System" is not suitable for $CO_2$ as extinguishing medium. As the gas pressure in the $CO_2$ extinguishing medium tank is heavily dependent on the temperature, unacceptable variations in the tripping temperature occur in the case of fluctuations in the ambient temperature. These variations in the tripping temperature are extremely hazardous in particular because a fall in the tripping temperature is ascertained at high ambient temperature and an increase at low ambient temperature.

A stationary $CO_2$ fire-extinguishing system with a fusible tripping/fire-extinguishing line is known from U.S. Pat. No. 4,356,868. In this $CO_2$ fire-extinguishing system the carbon dioxide tanks are connected via a gas distributor and a connecting line to a valve switch-cabinet housing a multi-part valve system. This valve system comprises inter alia a pneumatically trippable three-way valve, which is normally closed, and a pressure controller. The latter supplies carbon dioxide under a reduced pressure via a common connecting line, in which a flow limiter is integrated, to the fusible tripping/fire-extinguishing line and the pneumatic tripping device on the three-way valve. If a hole is formed in the fusible tripping/fire-extinguishing line in the case of a fire, carbon dioxide escapes through this hole with the result that the pressure in the tripping/fire-extinguishing line and consequently also in the tripping connection of the three-way valve falls. Consequently the pneumatic tripping device of the three-way valve is tripped. The latter now connects the tripping/fire extinguishing line via a bypass line of the pressure controller to the connecting line. The carbon dioxide under high pressure from the cylinders can now flow into the fire-extinguishing line via the bypass line and the three-way valve.

The present invention is based on the task of making the tripping temperature of fire-extinguishing equipment of the type described above more independent of variations in the ambient temperature by a new compact fire-extinguisher valve.

According to the invention this problem is solved by a fire-extinguisher valve that includes a pressure controller, arranged between the tripping chamber and the tripping connection of the valve. The pressure controller reduces the pressure in the fusible hollow body and weakens the effect of pressure fluctuations in the extinguishing medium tank on the pressure in the fusible hollow body, which is connected to the tripping connection. The tripping temperature, which is determined by the melting behaviour of the fusible hollow body and the internal pressure in the hollow body, thus becomes more independent of temperature variations, which cause pressure fluctuations in the extinguishing medium tank. Consequently fire-extinguishing equipment according to the invention can also be operated with $CO_2$ as extinguishing medium even with marked variations in the ambient temperature.

In addition the pressure controller arranged between the tripping chamber and the valve tripping connection offers the following advantages:

- the pressure in the fusible hollow body may be adjusted independently of the gas pressure in the extinguishing medium tank, so that the same fusible hollow body can be used for all extinguishing media and all filling pressures and the same tripping temperature is nevertheless achieved;
- the internal pressure in the fusible hollow body can easily be adjusted via the pressure controller and the tripping temperature thus adapted to local conditions. A higher tripping temperature can thus be adjusted via the pressure controller at a high ambient temperature in order to prevent faulty tripping;
- as a result of a lower pressure in the fusible hollow body the latter is subject to less stress, so that it ages more slowly and can remain in operation longer.

The fusible hollow body to be connected to the tripping connection of the valve is generally a fusible hose, which is sealed at its free end and is mounted above the point with a potential fire hazard. However, it would not be outside the scope of the invention to design the fusible hollow body e.g. as a small cylinder, a rigid pipe network or as a large-area cushion. The only important factor is that the fusible hollow body bursts under a specific internal pressure at a specified temperature (e.g. 100° C.) and allows the pressure gas to escape.

The fusible hollow body must, of course, also be sufficiently aging-resistant and diffusion-tight.

To prevent a pressure increase in the fusible hollow body, e.g. by heating of the gas in the hollow body or as a result of losses in the pressure controller, the fusible hollow body is advantageously connected to an overpressure valve.

The extinguishing medium may be an extinguishing powder or extinguishing liquid, the pressure medium being a propellant gas, e.g. nitrogen. However the extinguishing medium may also be an extinguishing gas. The invention offers the greatest advantages with carbon dioxide as extinguishing medium. It should be noted that this produces extremely simple, automatically tripping $CO_2$ fire-extinguishing equipment, which does not require electrical contacts, operates entirely without outside energy, requires little maintenance, is not susceptible to faults and also operates highly reliably under extreme ambient conditions. This automatically tripping $CO_2$ fire-extinguishing equipment can, for example, be used advantageously for protection of switchgear, machine rooms, electrical motors and emergency generating sets, whereby variations in the ambient temperature between −20° C. and +60° C. must often be anticipated.

With a fire-extinguisher valve according to the invention any portable or mobile $CO_2$ fire-extinguisher, for example, can be incorporated in automatically tripping fire-extinguishing equipment, which does not require an outside energy connection.

The proposed fire-extinguisher valve advantageously comprises a valve body and a valve cap, the pressure controller being installed in the valve cap. A locking device permits locking of the pressure controller in the closed position, so that emptying of the fire-extinguisher during removal of the fusible hollow body is prevented.

The pressure controller advantageously has a pretensioned spring element, whereby the pressure in the tripping connection of the fire-extinguisher valve can be established via the pretensioning of the spring element. The pressure in the tripping connection and thus the tripping temperature can then be set by changing the pretension of the spring element.

An exemplified embodiment of the fire-extinguishing equipment and fire-extinguisher valve according to the invention is described with the aid of the attached drawings.

Figure 1:
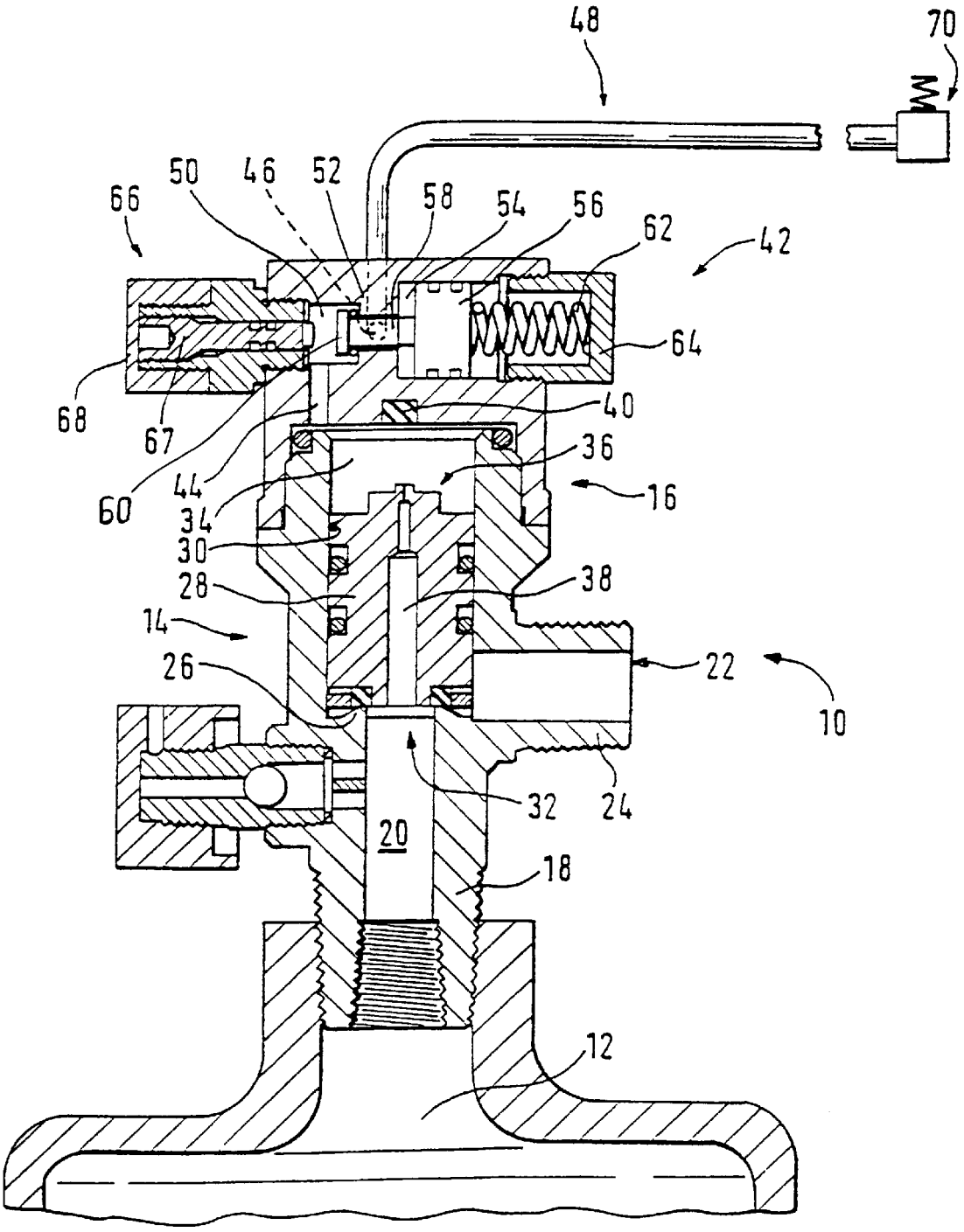
FIG. 1 shows a longitudinal section through a fire-extinguisher valve 10 according to the invention, which is incorporated in fire-extinguishing equipment according to the invention.

The fire-extinguisher valve 10 is screwed on to an extinguishing medium tank 12. In the described embodiment this extinguishing medium tank 12 is, for example, a $CO_2$ cylinder, only a cross-section of the cylinder neck being shown. The gas pressure in the $CO_2$ cylinder is, for example, 60 bar at an ambient temperature of 20° C. If the ambient temperature rises to 60° C., however, the gas pressure in the $CO_2$ cylinder may increase to between 170 and 220 bar depending on the filling factor.

The fire-extinguisher valve 10 consists essentially of a valve body 14, as also used, for example, in manually trippable $CO_2$ fire-extinguishers, and a new type of valve cap 16.

The valve body 14 comprises a connection piece 18, which can be screwed into the neck of the $CO_2$ cylinder 12. A connection duct 20, which is connected directly to the interior of the $CO_2$ cylinder 12, is formed in the connection piece 18. The reference number 22 indicates an outlet duct for the extinguishing medium, which is arranged in a lateral connection piece 24 of the valve body 14. A valve seat 26, to which a closing element 28 is assigned, is arranged between connection duct 20 and outlet duct 22. The closing element is designed as a closing piston, which is fitted so as to be axially movable in a cylindrical chamber 30 above the valve seat. In the valve position shown the closing element 28 rests with its end face 32 sealed against the valve seat 26, the connection between connection duct 20 and outlet duct 22 being closed gastight via the valve seat 26.

The cylindrical chamber 30 is closed axially by the valve cap 16, so that a chamber 34, which is designated tripping chamber 34 below, is separated behind the closing element 28. In this tripping chamber the second end face 36 of the closing piston 28 forms a pressure area. The closing piston 28 has an axial hole or connecting duct 38, which terminates centrally in the first and second end faces 32 and 36. The same pressure as in the connection duct 20 can be established in the tripping chamber 34 via this hole 38. As the cross-section of the tripping chamber 34 is larger than that of the seat 26, a hydrostatic closing force acts-when the pressure is the same in the tripping chamber 34 and connection duct 20—in the direction of the valve seat 26 on the closing piston 28, which rests sealed against the valve seat 26. If, by contrast, a pressure drop is caused in the tripping chamber 34, i.e. the gas is discharged from the tripping chamber 34 more quickly than it can be replenished via the hole 38, a hydrostatic opening force, which acts in the direction of the valve cap 16 on the closing piston 28, is produced. The latter is pressed against the valve cap 16, whereby a sealing element 40 closes the termination of the hole 38, so that no more gas can flow into the tripping chamber 34. The valve is now opened and the extinguishing medium can flow via the valve seat 26 into the connection piece 24, where it can be discharged from the valve via the outlet duct 22.

A pressure controller 42, which is connected via a duct 44 to the tripping chamber 34, is installed in the valve cap 16. On the outlet side the pressure controller has a tripping connection 46, to which a so-called "Fire Trace®" hose 48 is connected. This hose is a hollow body designed in such a way that it bursts under a specific internal pressure, if its wall temperature exceeds a specific limit value at one point.

The internal pressure in the hose 48 is established by the pressure controller 42, which is installed between the tripping chamber 34 and tripping connection 46. This can thus reduce the higher gas pressure in the extinguishing medium tank 12 to a lower internal pressure in the hose 48, which corresponds to the required tripping temperature. If the gas pressure in the extinguishing medium tank 12 changes, the pressure controller 42 maintains the internal pressure in the hose 48 at a largely constant level or at least substantially reduces the extent of the pressure fluctuations in the hose 48.

Various types of pressure controllers can be designed. FIG. 1 shows, for example, a particularly simple springloaded pressure controller 42. This pressure controller has a first chamber 50, which is connected via a connecting hole 52 to a second chamber 54. In the second chamber 54 an actuating piston 56 can be fitted so as to be axially movable. A shaft 58, which has a smaller diameter than the connecting hole 52, connects the actuating piston 56 mechanically to a closing body 60 in the first chamber 50. A seat, which encloses the termination of the connecting hole 52 into the first chamber 50, is assigned to this closing body 60, which has a sealing ring. The free cross-section of the seat is substantially smaller than the cross-section of the second chamber 54. A spring 62 exerts a spring force on the actuating piston 56 in the direction of the first chamber 50. This spring 62 is pretensioned by a cap 64, which can be screwed in. Under the spring force the closing body 60 is lifted from its seat, so that gas can flow from the first chamber 50 via the connecting hole 52 into the second chamber 54 and via the tripping connection 46 into the hose 48. A pressure, which exerts a hydrostatic force on the actuating piston 56, builds up in the second chamber 54. This hydrostatic force counteracts the spring force and finally moves the actuating piston 56 in the direction of the cap 64 until the closing body 60 rests on its seat and acts as a seal. A pressure increase in the cylinder 12 can now no longer act on the pressure in the hose 48. If, by contrast, the hose 48 bursts as intended in the event of a fire, the pressure in the second chamber 54 falls to ambient pressure and the spring 62 pushes the actuating piston 56 towards the first chamber 50, so that the closing body 60 is lifted off its seat. In this case the spring 62 must, of course, overcome the hydrostatic force, which the gas pressure in the chamber 50 exerts on the closing body 60. The gas can now flow from the tripping chamber 34 via the duct 44, the chamber 50, the connecting hole 52 and the tripping connection 46 into the burst hose 48 and escape into the environment. As the gas flows away more quickly from the tripping chamber 34 than new gas flows in via the hole 38, the closing piston 28 is forced by the pressure in the cylinder 12 against the cap 16, as described above. Gas can now no longer flow into the tripping chamber 34, so that the valve remains open until the cylinder 12 is fully emptied.

The reference number 66 designates a locking device for the pressure controller 42. This locking device 66, which is installed in the valve cap 16 as an axial extension of the pressure controller 42, comprises, for example, a setscrew 67, which presses the closing body 60 against its seat when screwed in. A sealable cap 68 prevents access to the setscrew 67. When the pressure controller 42 is in the locked position the hose 48 can be dismantled from the tripping connection 46 without tripping the valve.

An overpressure valve 70 is advantageously connected to the hose 48 to prevent the pressure in the hose 48 increasing with time in the event of small leaks in the pressure controller.

Figure 2:
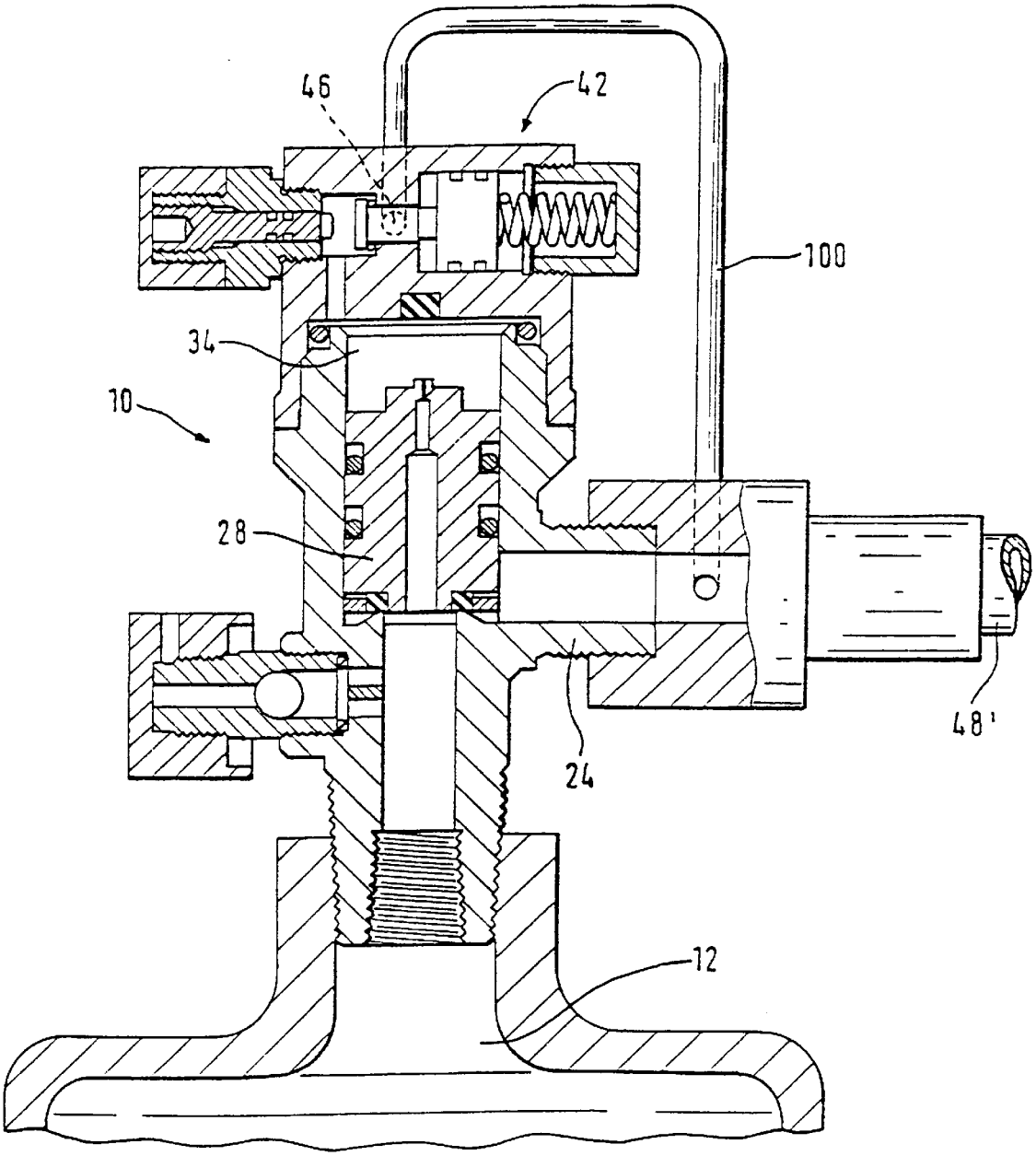
FIG. 2 shows the fire-extinguisher valve according to the invention in FIG. 1 in an alternative embodiment of the fire-extinguisher equipment according to the invention.

FIG. 2 shows incorporation of the fire-extinguisher valve 10 described above in an alternative embodiment of the fire-extinguishing equipment according to the invention. In this embodiment a "Fire Trace®" hose 48' is connected directly to the connection piece 24 of the valve 10. This "Fire Trace®" hose 48' forms the fusible closed hollow body, which is connected to the tripping connection 46 of the fire-extinguisher valve 10 via a connecting line 100. The connecting line 100 could, of course, also be integrated directly in the valve 10. An internal pressure established by the pressure controller 42 thus prevails in the "Fire Trace®" hose 48' when the valve is closed. In the event of a fire the "Fire Trace®" hose 48' bursts above the seat of the fire and the pressure in the "Fire Trace®" hose 48' falls to ambient pressure. The pressure controller 42 in the valve 10 opens and causes a pressure drop in the tripping chamber 34 of the valve 10. The closing piston 28 is lifted off its valve seat 26 and the extinguishing medium can flow through the connection piece 24 into the "Fire Trace®" hose 48'. The extinguishing medium flows through this "Fire Trace®" hose 48', which advantageously has a larger cross-section than the "Fire Trace®" hose 48' in FIG. 1, to the burst point above the seat of the fire and is released there. This fire-extinguishing equipment consequently has the additional advantage that the extinguishing medium is released above the seat of the fire, the unreduced internal pressure in the extinguishing medium tank 12 being available for release of the extinguishing medium.

I claim:

1. Fire-extinguisher valve comprising: a connection piece (18) for screwing the valve on to an extinguishing medium tank (12), a valve seat (26), a closing element (28), which is assigned to the valve seat (26), a tripping chamber (34), in which the closing element (28) forms a pressure area, connection means, which connect the tripping chamber (34) to the connection piece under pressure, the closing element (28) with its pressure area being designed and arranged in such a way that in the case of pressure equalisation between the connection piece (18) and the tripping chamber (34) the closing element (28) is pressed against the valve seat (26), a tripping connection (46), which is connected to the tripping chamber (34), whereby a pressure drop in the tripping chamber (34) can be produced via the tripping connection (46), so that the closing element (28) is lifted off its valve seat (26), an outlet connection (24) with an outlet duct (22) for the extinguishing medium, wherein this outlet duct (22) is arranged in such a way that when the closing element (28) is lifted off the valve seat (26) the extinguishing medium flows via the valve seat (26) into the outlet duct (22), characterised by a pressure controller (42), which is arranged between the tripping chamber (34) and the tripping connection (46).

2. Fire-extinguisher valve according to claim 1, characterised by a connecting line between the outlet duct (22) for the extinguishing medium and the tripping connection (46).

3. Fire-extinguisher valve according to claim 2, characterised in that the closing element (28) is a closing piston and the tripping chamber (34) is connected under pressure to the connection piece (18) via a connecting duct (38) in the closing piston (28).

4. Fire-extinguisher valve according to claim 3, characterised in that the closing piston forms a first and second end face (32, 36), wherein the first end face (32) can be pressed against the valve seat (26) to seal off said valve seat (26), wherein the connecting duct (38) in the closing piston (28) forms a central termination in the first and second end face (32, 36), and wherein the second end face (36) can be pressed against a second sealing seat in such a way that the termination of the connecting duct (38) in the second end face (36) is sealed towards the tripping chamber (34).

5. Fire-extinguisher valve according to claim 1, characterised by a valve body (14) and a valve cap (16), the pressure controller (42) being installed in the valve cap (16).

6. Fire-extinguisher valve according to claim 1, characterised by a locking device (66) for locking the pressure controller (42) in the closed position.

7. Fire-extinguisher valve according to claim 1, characterised in that the pressure controller (42) has a pretensioned spring element (62), whereby the pressure in the tripping connection (46) can be established via the pretension of the spring element (62).

8. Fire-extinguishing equipment comprising a carbon dioxide cylinder with a screwed-on fire-extinguisher valve according to claim 1.

9. Fire-extinguishing equipment according to claim 8, characterised by a fusible tripping hose (48), which is connected to the tripping connection (46).

10. Fire-extinguishing equipment according to claim 8, characterised by a fusible tripping hose (48'), which is connected to the outlet connection (24) and a connecting line (100), which connects the tripping hose (48') to the tripping connection (46).

11. Fire-extinguishing equipment, according to claim 8, characterised by an overpressure valve (70), to which the fusible tripping hose (48) is connected.

12. Fire-extinguishing equipment according to claim 9, characterized by a connecting line between the outlet duct (22) for the extinguishing medium and the tripping connection (46).

13. Fire-extinguishing equipment according to claim 9, characterized in that the closing element (28) is a closing piston and the tripping chamber (34) is connected under pressure to the connection piece (18) via a connecting duct (38) in the closing piston (28).

14. Fire-extinguishing equipment according to claim 13, characterized in that the closing piston forms a first and second end face (32, 36), wherein the first end face (32) can be pressed against the valve seat (26) to seal off said valve seat (26), wherein the connecting duct (38) in the closing piston (28) forms a central termination in the first and second end face (32, 36), and wherein the second end face (36) can be pressed against a second sealing seat in such a way that the termination of the connecting duct (38) in the second end face (36) is sealed towards the tripping chamber (34).

15. Fire-extinguishing equipment according to claim 9, characterized by a valve body (14) and a valve cap (16), the pressure controller (42) being installed in the valve cap (16).

16. Fire-extinguishing equipment according to claim 9, characterized by a locking device (66) for locking the pressure controller (42) in the closed position.

17. Fire-extinguishing equipment according to claim 9, characterized in that the pressure controller (42) has a pretensioned spring element (62), whereby the pressure in the tripping connection (46) can be established via the pretension of the spring element (62).

* * * * *